US008882474B2

(12) United States Patent
Ota et al.

(10) Patent No.: US 8,882,474 B2
(45) Date of Patent: Nov. 11, 2014

(54) VARIABLE DISPLACEMENT TYPE COMPRESSOR WITH DISPLACEMENT CONTROL MECHANISM

(75) Inventors: Masaki Ota, Kariya (JP); Hiroshi Kubo, Kariya (JP); Ryo Matsubara, Kariya (JP); Yasuhiro Tabe, Kariya (JP); Hideharu Yamashita, Kariya (JP); Yuki Morikage, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 655 days.

(21) Appl. No.: 12/606,355

(22) Filed: Oct. 27, 2009

(65) Prior Publication Data

US 2010/0104454 A1 Apr. 29, 2010

(30) Foreign Application Priority Data

Oct. 28, 2008 (JP) ..... 2008-276749

(51) Int. Cl.
*F04B 1/28* (2006.01)
*F04B 1/14* (2006.01)
*F04B 27/18* (2006.01)

(52) U.S. Cl.
CPC ..... *F04B 27/1804* (2013.01); *F04B 2027/1881* (2013.01); *F04B 2027/1872* (2013.01); *F04B 2027/1827* (2013.01); *F04B 2027/1859* (2013.01); *F04B 2027/1854* (2013.01)
USPC ..... 417/222.1; 417/222.2; 417/269; 417/271; 92/12.2; 92/13

(58) Field of Classification Search
USPC ..... 417/222.1, 222.2, 269, 271; 92/12.2, 13
See application file for complete search history.

(56) References Cited

U.S. PATENT DOCUMENTS 6,517,323 B2 * 2/2003 Kimura et al. ..... 417/222.2
2002/0006337 A1 1/2002 Kimura et al.

(Continued)

FOREIGN PATENT DOCUMENTS

EP 1 172 559 A2 1/2002
EP 1 479 908 A2 11/2004

(Continued)

OTHER PUBLICATIONS

Machine Translation of JP 2002-155857.*

(Continued)

*Primary Examiner* — Charles Freay
*Assistant Examiner* — Christopher Bobish
(74) *Attorney, Agent, or Firm* — Locke Lord LLP

(57) ABSTRACT

A variable displacement type compressor has a supply passage for supplying refrigerant gas to a pressure control chamber, a release passage for releasing the refrigerant gas from the pressure control chamber, a first control valve for controlling the amount of the refrigerant gas flowing through the supply passage, a check valve provided between the first control valve and the pressure control chamber and preventing the refrigerant gas from flowing from the pressure control chamber to the first control valve by closing the supply passage and a second control valve for adjusting a cross-sectional area of the release passage from minimum to maximum. The second control valve has a back pressure chamber communicating with the supply passage, a valve chamber forming a part of the release passage and communicating with a suction-pressure region, a valve hole forming a part of the release passage and communicating with the valve chamber and a spool having a valve portion located in the valve chamber. When a pressure in the back pressure chamber increases, the valve portion decreases the degree of opening of the valve hole.

10 Claims, 5 Drawing Sheets

(56) References Cited

U.S. PATENT DOCUMENTS

| | | | | |
|---|---|---|---|---|
| 2004/0258536 | A1* | 12/2004 | Ota et al. | 417/222.2 |
| 2005/0008499 | A1* | 1/2005 | Umemura et al. | 417/222.2 |
| 2006/0080983 | A1* | 4/2006 | Ota et al. | 62/208 |

FOREIGN PATENT DOCUMENTS

| | | | | | |
|---|---|---|---|---|---|
| EP | 1 489 304 | A1 | | 12/2004 | |
| EP | 1 586 772 | A1 | | 10/2005 | |
| JP | 4-134188 | A | | 5/1992 | |
| JP | 5-164043 | A | | 6/1993 | |
| JP | 2001-123946 | A | | 5/2001 | |
| JP | 2002-21721 | A | | 1/2002 | |
| JP | 2002155857 | A | * | 5/2002 | F04B 27/08 |
| JP | 2004-346880 | A | | 12/2004 | |

OTHER PUBLICATIONS

Korean Office Action issued in corresponding Korean patent application No. 040544173, issued Jul. 21, 2011.

Communication (dated Mar. 11, 2014) in EP application No. 09 172 440.1.

* cited by examiner

VARIABLE DISPLACEMENT TYPE COMPRESSOR WITH DISPLACEMENT CONTROL MECHANISM

BACKGROUND OF THE INVENTION

The present invention relates to a displacement control mechanism for a variable displacement type compressor which is operable to adjust the pressure in a pressure control chamber by supplying refrigerant gas in a discharge-pressure region of the compressor into the pressure control chamber and releasing the refrigerant gas in the pressure control chamber to a suction-pressure region of the compressor, thereby controlling the displacement of the compressor.

In a variable displacement type compressor provided with a pressure control chamber having therein a swash plate whose inclination angle is variable, the inclination angle of the swash plate decreases with an increase of the pressure in the pressure control chamber. On the other hand, the inclination angle of the swash plate increases with a decrease of the pressure in the pressure control chamber. When the inclination angle of the swash plate decreases, the stroke of a piston decreases thereby to decrease the displacement of the compressor. When the inclination angle of the swash plate increases, the stroke of the piston increases thereby to increase the displacement of the compressor.

Since the refrigerant gas which is supplied to the pressure control chamber has been already compressed, the operating efficiency of the variable displacement type compressor deteriorates as the amount of refrigerant gas released from the pressure control chamber to the suction-pressure region of the compressor increases. Therefore, the cross-sectional area of a release passage through which the refrigerant gas is released from the pressure control chamber to the suction-pressure region should be small as much as possible in view of the operating efficiency with the result that a fixed throttle is provided in the release passage so as to decrease the cross-sectional area thereof.

If the compressor is left in a stopped state for a long time, the refrigerant gas is changed into a liquid state and the liquefied refrigerant is accumulated in the pressure control chamber. When the compressor is started in such a state, the liquefied refrigerant is not released rapidly to the suction-pressure region if the release passage has a fixed throttle with a small cross-sectional area. As a result, the liquefied refrigerant is vaporized in the pressure control chamber and the pressure in the pressure control chamber is increased excessively. Therefore, it takes a long time before the displacement of the compressor is increased to a desired level after the compressor is started.

A variable displacement type compressor with a displacement control mechanism is disclosed in Japanese Patent Application Publication NO. 2004-346880 to solve the above problem. The displacement control mechanism of this Publication has a first control valve which adjusts the cross-sectional area of a supply passage through which refrigerant gas is supplied from a discharge-pressure region to the pressure control chamber and a second control valve which adjusts the cross-sectional area of a release passage through which refrigerant gas is released from the pressure control chamber to the suction-pressure region. The release passage of the displacement control mechanism of the same Publication includes a first release passage having the second control valve therein and a second release passage interconnecting the pressure control chamber and the suction-pressure region directly without the second control valve.

The first control valve of the Publication is an electromagnetic control valve which is operable to adjust the degree of opening by changing the electromagnetic force. When the first control valve is in de-energized state, the degree of opening of the first control valve is maximum and the inclination angle of the swash plate is minimum, accordingly. This state corresponds to the minimum displacement operation of the compressor in which the displacement thereof is fixed at minimum. When the first control valve is in maximum energized state, the degree of opening thereof is minimum and the inclination angle of the swash plate is maximum, accordingly. When the first control valve is in an energized state that is smaller than the maximum energized state, the degree of opening thereof becomes smaller than the maximum and then the inclination angle of the swash plate is between the maximum and the minimum. This state corresponds to an intermediate displacement operation in which the displacement is not fixed.

The second control valve has a spool accommodated in a spool chamber and separating the spool chamber into a valve chamber and a back pressure chamber. The back pressure chamber communicates with a pressure region downstream of the first control valve and the valve chamber communicates with the pressure control chamber through a valve hole and also with the suction-pressure region of the compressor through a communication passage. The spool is urged by a spring toward the back pressure chamber, i.e., in the direction to increase the degree of opening of the valve hole.

When the compressor is started and the first control valve is closed, the pressure in the back pressure chamber of the second control valve becomes substantially the same as that in the pressure control chamber and the spool of the second control valve is moved by the spring so that the degree of opening of the second control valve becomes the maximum. Thus, the liquefied refrigerant in the pressure control chamber is rapidly released to the suction-pressure region, thereby reducing the time before the displacement is increased to a desired level after the variable displacement type compressor has been started. Even if the amount of blow-by gas passing through from a cylinder bore to the pressure control chamber increases after the liquefied refrigerant is discharged from the pressure control chamber, the blow-by gas is flowed out through the first and second release passages as long as the first control valve closes the supply passage.

When the supply passage is opened slightly by the first control valve, the pressure in the back pressure chamber becomes greater than that in the pressure control chamber, with the result that the spool moves against the spring so that the degree of opening of the second control valve becomes minimum that is not zero. Therefore, the second control valve functions in the same way as the fixed throttle thereby to prevent the deterioration of the operating efficiency caused by providing the displacement control mechanism.

In the second control valve in the aforementioned Publication, the spring force of the spring is often set small so that the spool of the second control valve can move quickly in the direction to minimize the degree of opening of the second control valve when the differential pressure between the back pressure chamber and the pressure control chamber is small. For example, in a clutchless variable displacement type compressor which is connected to a drive source without a clutch mechanism, since the first control valve is not energized when the compressor is started, the spool of the second control valve moves quickly in the direction to minimize the degree of opening of the second control valve by the increased discharge pressure. Since the liquefied refrigerant in the pressure control chamber is then stirred and the pressure in the pressure control chamber increases, the spool is urged in the direction to minimize the degree of opening of the second control valve by the pressure of the pressure control chamber, with the result that the degree of opening of the second control valve can not be maximized. Accordingly, the liquefied refrigerant is not discharged to the suction-pressure region quickly after a start-up of the compressor and it adversely takes a long time before the displacement of the compressor is increased to a desired level.

In a clutch variable displacement type compressor which is connected to a drive source through a clutch mechanism, when the first control valve is energized during the operation of the compressor with the degree of opening of the first control valve greater than the minimum, the spool of the second control valve moves quickly in the direction to minimize the degree of opening of the second control valve as the discharge pressure increases. When the high-pressure blow-by gas is then discharged to the pressure control chamber, the pressure in the pressure control chamber increases and the refrigerant gas in the pressure control chamber flows into the back pressure chamber through the supply passage. Accordingly, the spool is urged in the direction to minimize the degree of opening of the second control valve by the pressure in the back pressure chamber, so that the second control valve is unable to maximize the degree of its opening. Therefore, the second control valve become unable to adjust the discharge of refrigerant gas through the release passage, so that the adjustment of the swash plate to the desired inclination angle cannot be accomplished.

The present invention, which has been made in light of the above problems, is directed to providing a variable displacement type compressor with a displacement control mechanism permitting the second control valve to operate at such a timing that prevents the above-described deterioration of the operating efficiency of the compressor.

SUMMARY OF THE INVENTION

A variable displacement type compressor has a supply passage for supplying refrigerant gas to a pressure control chamber, a release passage for releasing the refrigerant gas from the pressure control chamber, a first control valve for controlling the amount of the refrigerant gas flowing through the supply passage, a check valve provided between the first control valve and the pressure control chamber and preventing the refrigerant gas from flowing from the pressure control chamber to the first control valve by closing the supply passage and a second control valve for adjusting a cross-sectional area of the release passage from minimum to maximum. The second control valve has a back pressure chamber communicating with the supply passage, a valve chamber forming a part of the release passage and communicating with a suction-pressure region, a valve hole forming a part of the release passage and communicating with the valve chamber and a spool having a valve portion located in the valve chamber. When a pressure in the back pressure chamber increases, the valve portion decreases the degree of opening of the valve hole.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

First Embodiment

Figure 1:
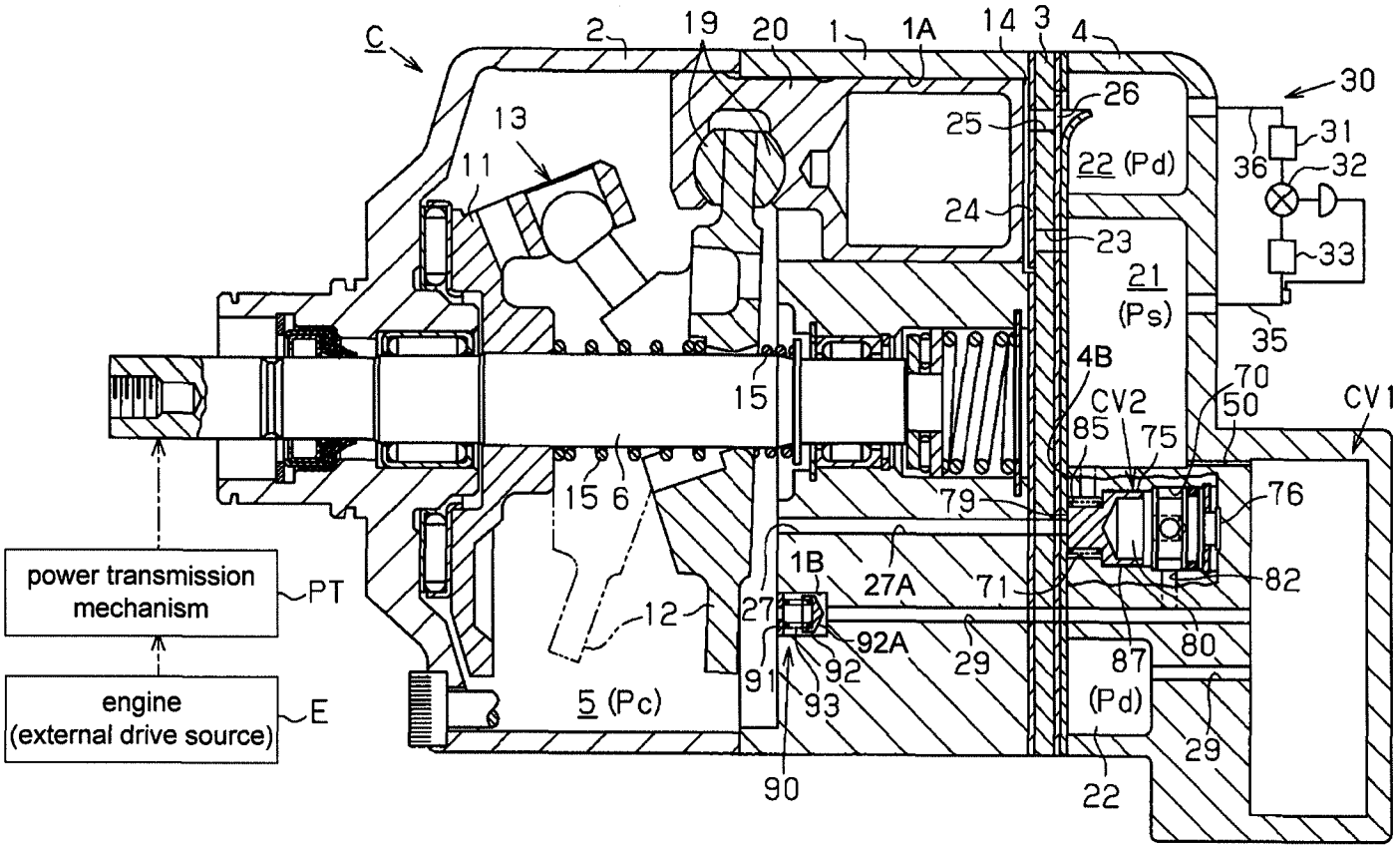
FIG. 1 is a longitudinal sectional view of a variable displacement type compressor according to a preferred first embodiment of the present invention.

The following will describe the first embodiment of a variable displacement type compressor (hereinafter, simply referred to as compressor) with a displacement control mechanism according to the present invention, which may be used for a vehicle air conditioner to compress refrigerant gas. Referring to FIG. 1, the compressor is generally designated by C. The left side and the right side of the compressor C as viewed in FIG. 1 correspond to the front side and the rear side thereof.

As shown in FIG. 1, the compressor C has a housing including a cylinder block 1, a front housing 2 connected to the front end of the cylinder block 1 and a rear housing 4 connected to the rear end of the cylinder block 1 through a valve plate assembly 3. The cylinder block 1 and the front housing 2 cooperate to define a pressure control chamber 5 in the housing. A rotary shaft 6 is rotatably supported by the cylinder block 1 and the front housing 2. A lug plate 11 is fixed to the rotary shaft 6 for rotation therewith in the pressure control chamber 5.

Front end of the rotary shaft 6 is connected to a vehicle engine E serving as an external drive source through a power transmission mechanism PT. The power transmission mechanism PT may be a clutch mechanism (e.g. an electromagnetic clutch) that selectively transmits and stops driving force by an external electrical control, or a continuous transmission type clutchless mechanism (e.g., a combination of a belt and a pulley) without the above clutch mechanism. In the present invention, the clutchless type power transmission mechanism PT is employed.

A swash plate 12 is provided in the pressure control chamber 5. The swash plate 12 is slidably and inclinably supported by the rotary shaft 6 and urged by a spring 15. A hinge mechanism 13 is interposed between the lug plate 11 and the swash plate 12. Thus, the hinge mechanism 13 between the lug plate 11 and the swash plate 12 supported by the rotary shaft 6 and the urging force of the spring 15 allows the swash plate 12 to rotate integrally with the lug plate 11 and the rotary shaft 6 and also to incline with respect to the rotary shaft 6 while sliding in the axial direction of the rotary shaft 6.

The cylinder block 1 has formed therethrough a plurality of cylinder bores 1A (one cylinder bore is shown in FIG. 1) arranged around the rotary shaft 6 and a piston 20 is slidably received in each cylinder bore 1A. Front and rear openings of each cylinder bore 1A are closed by the valve plate assembly 3 and the piston 20, respectively. A compression chamber 14 is defined in each cylinder bore 1A and the volume of the compression chamber 14 is varied in accordance with the reciprocating movement of the piston 20. Each piston 20 is engaged with the outer periphery of the swash plate 12 through a pair of shoes 19. Thus, the rotation of the swash plate 12 in accordance with the rotation of the rotary shaft 6 is converted into the reciprocating movement of the piston 20 in its corresponding cylinder bore 1A through the shoes 19.

The valve plate assembly 3 and the rear housing 4 cooperate to define therebetween a suction chamber 21 located in the center region of the rear housing 4 and a discharge chamber 22 in the region surrounding the suction chamber 21. The valve plate assembly 3 has formed therethrough a suction port 23 and a discharge port 25. The valve plate assembly 3 is formed with a suction valve 24 for opening and closing the suction port 23 and a discharge valve 26 for opening and closing the discharge port 25. The suction chamber 21 communicates with each of the cylinder bores 1A (compression chamber 14) thorough the suction port 23 and the discharge chamber 22 communicates with each of the cylinder bores 1A (compression chamber 14) through the discharge port 25.

Refrigerant gas in the suction chamber 21 flows into the compression chamber 14 through the suction port 23 as its corresponding piston 20 moves from the top dead center toward the bottom dead center. Refrigerant gas compressed to the desired level in the compression chamber 14 with the movement of the piston 20 from the bottom dead center to the top dead center is discharged into the discharge chamber 22 through the discharge port 25.

The refrigerant circulation circuit (or refrigeration cycle) for the vehicle air conditioner includes the compressor C and an external refrigerant circuit 30. The external refrigerant circuit 30 has, e.g., a gas cooler 31, an expansion valve 32 and an evaporator 33. A conduit 35 for the refrigerant gas is provided in the downstream region of the external refrigerant circuit 30, interconnecting the outlet of the evaporator 33 and the suction chamber 21 of the compressor C. Another conduit 36 for the refrigerant gas is provided in the upstream region of the external refrigerant circuit 30, interconnecting the discharge chamber 22 of the compressor C and the inlet of the gas cooler 31.

The inclination angle of the swash plate 12, or the angle made between the swash plate 12 and an imaginary plane extending perpendicularly to an axis of the rotary shaft 6, is varied in accordance with the pressure (crank pressure Pc) in the pressure control chamber 5 and variable between the minimum inclination angle (shown by a solid line in FIG. 1) and the maximum inclination angle (shown by a two-dot chain line in FIG. 1).

The displacement control mechanism for controlling the crank pressure Pc that controls the inclination angle of the swash plate 12 includes a release passage 27, a supply passage 29, a first control valve CV1, a second control valve CV2 and a check valve 90 all provided in the housing.

The release passage 27 interconnects the pressure control chamber 5 and the suction chamber 21 that is a part of the suction-pressure (Ps) region of the compressor C. The second control valve CV2 is provided in the midstream of the release passage 27 for adjusting the cross-sectional area of the release passage 27. The supply passage 29 interconnects the pressure control chamber 5 and the discharge chamber 22 that is a part of the discharge-pressure (Pd) region of the compressor. The first control valve CV1 is provided in the supply passage 29 for adjusting the cross-sectional area of the supply passage 29 and a check valve 90 is provided in the supply passage 29 between the pressure control chamber 5 and the first control valve CV1.

In the compressor C, the degree of opening of each of the first control valve CV1 and the second control valve CV2 is adjusted for controlling the balance between the amount of high-pressure refrigerant gas flowed into the pressure control chamber 5 through the supply passage 29 and the amount of refrigerant gas flowed out from the pressure control chamber 5 through the release passage 27, thereby determining the crank pressure Pc. The differential pressure between the crank pressure Pc and the pressure in the cylinder bore 1A via the piston 20 is varied in accordance with the crank pressure Pc, which causes the inclination angle of the swash plate 12 to be changed with the result that the stroke length of the piston 20, i.e., the displacement of the compressor is adjusted.

When the degree of opening of the first control valve CV1 decreases and the crank pressure Pc reduces, the inclination angle of the swash plate 12 increases and the displacement of the compressor C is increased. On the other hand, when the degree of opening of the first control valve CV1 increases and the crank pressure Pc increases, the inclination angle of the swash plate 12 decreases and the displacement of the compressor C is decreased.

Figure 2:
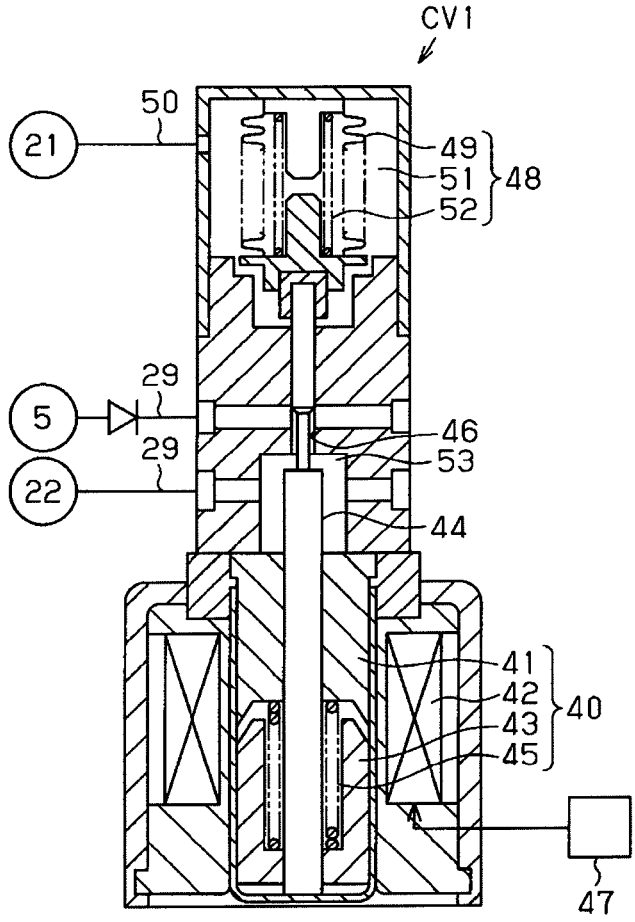
FIG. 2 is a cross-sectional view of a first control valve of the compressor of FIG. 1.

The following will describe the first control valve CV1. As shown in FIG. 2, the first control valve CV1 has a solenoid 40 which includes a fixed core 41, a movable core 43 and a coil 42. The movable core 43 is attracted toward the fixed core 41 when the coil 42 is excited. The first control valve CV1 has formed therein a communication passage 46 which is opened and closed by a valve rod 44 secured to the movable core 43. The solenoid 40 further includes a spring 45 which is interposed between the fixed core 41 and the movable core 43 for urging the valve rod 44 through the movable core 43 in the direction to open the communication passage 46. The electromagnetic force of the solenoid 40 urges the valve rod 44 against the spring force of the spring 45 in the direction to close the communication passage 46. Current supply to the solenoid 40 to excite the coil 42 is controlled by a controller 47 (controlled with duty ratio in the present embodiment).

The first control valve CV1 further has a pressure sensing device 48 which includes a bellows 49, a pressure sensing chamber 51 and a spring 52. The bellows 49 receives suction pressure Ps of the suction chamber 21 through a passage 50 and the pressure sensing chamber 51. The valve rod 44 is connected to the bellows 49, and the pressure in the bellows 49 and the spring force of the spring 52 urges the valve rod 44 in the direction to open the communication passage 46. A valve accommodation chamber 53 is formed in the first control valve CV1 in communication with the communication passage 46. The valve accommodation chamber 53 communicates with the discharge chamber 22 and the communication passage 46 communicates with the pressure control chamber 5, respectively, through a part of the supply passage 29.

The controller 47 controlling current supply (with duty ratio) to the solenoid 40 of the first control valve CV1 supplies current to the solenoid 40 with air conditioner switch (not shown) turned on, and stops the current supply with the air conditioner switch turned off. A room temperature setting device (not shown) and a room temperature detector (not shown) are electrically connected to the controller 47. With the air conditioner switch turned on, the controller 47 controls current supply to the solenoid 40 based on the temperature difference between a target temperature set by the room temperature setting device and an actual temperature detected by the room temperature detector.

The degree of opening of the communication passage 46 of the first control valve CV1, i.e., the degree of opening of the first control valve CV1, depends on the balance among various forces such as the electromagnetic force generated by the solenoid 40, the spring force of the spring 45 and the urging force of the pressure sensing device 48. The degree of opening of the first control valve CV1 can be continuously adjusted by changing the electromagnetic force. Specifically, as the electromagnetic force increases, the degree of opening of the first control valve CV1 decreases. Furthermore, as the suction pressure Ps in the suction chamber 21 increases, the degree of opening of the first control valve CV1 increases and the cross-sectional area of the supply passage 29 increases. On the other hand, as the suction pressure Ps in the suction chamber 21 decreases, the degree of opening of the first control valve CV1 decreases and the cross-sectional area of the supply passage 29 decreases.

Figure 3:
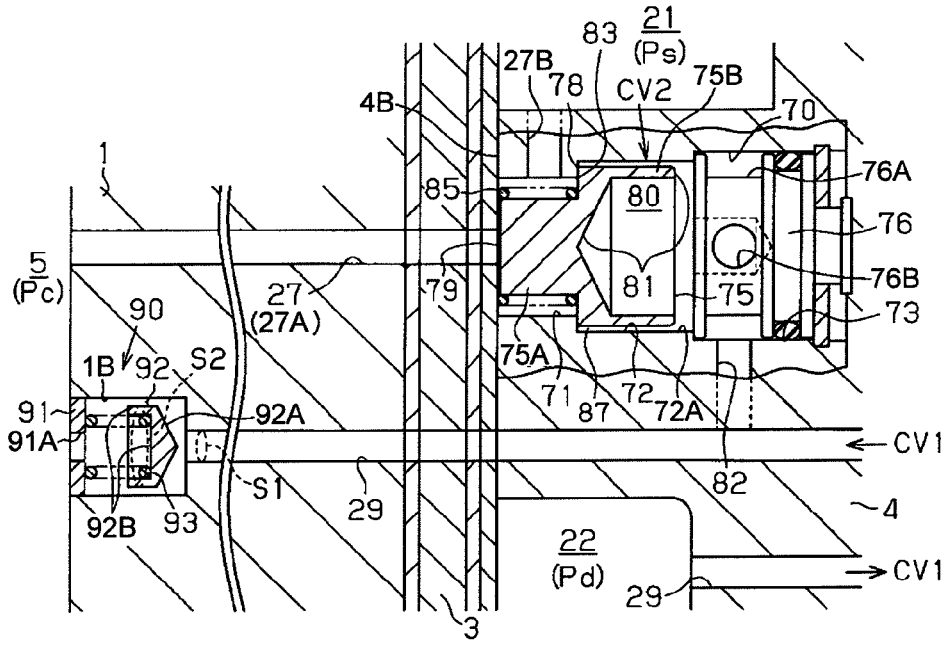
FIG. 3 is an enlarged fragmentary cross-sectional view showing a second control valve and a check valve of the compressor of FIG. 1, wherein the degree of opening of the second control valve is minimum and the check valve is opened.
Figure 4:
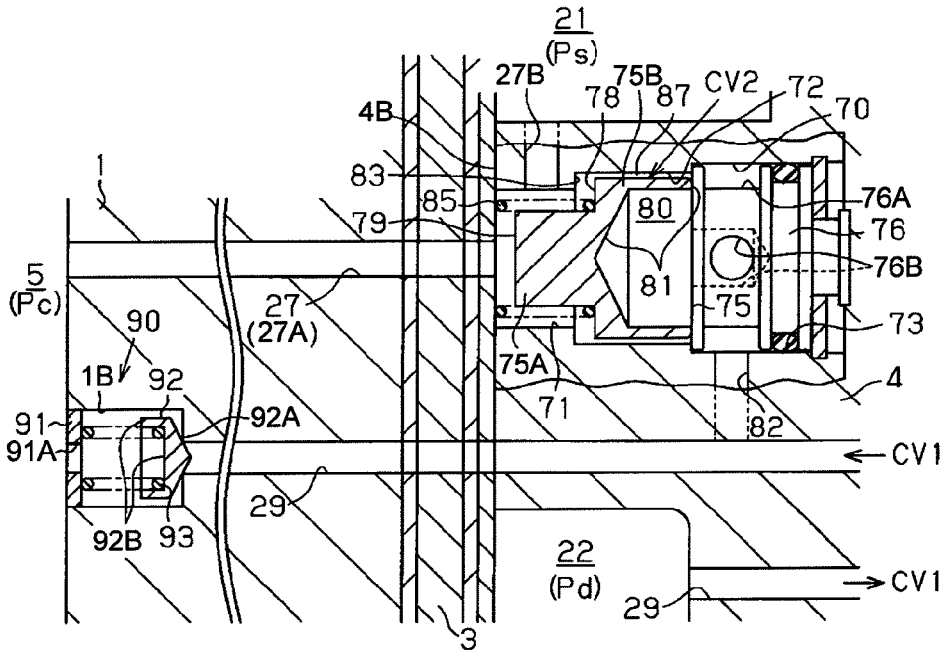
FIG. 4 is an enlarged fragmentary cross-sectional view similar to FIG. 3, but showing a state of the compressor when the degree of opening of the second control valve is maximum and the check valve is closed.

The following will describe the second control valve CV2. As shown in FIGS. 3 and 4, the rear housing 4 has formed therein a cylindrical accommodation hole 70 for accommodating therein the second control valve CV2. The rear housing 4 serves also as a valve housing for the second control valve CV2. Opening of the accommodation hole 70 at the front end 4B of the rear housing 4 is closed by the valve plate assembly 3. The accommodation hole 70 includes a valve chamber 71, a middle-diameter hole 72 whose diameter is greater than that of the valve chamber 71 and a large-diameter hole 73 whose diameter is greater than that of the middle-diameter hole 72. The valve chamber 71 and the holes 72, 73 are formed coaxially in this order rearward away from the valve plate assembly 3.

The valve chamber 71 communicates with the pressure control chamber 5 through a valve hole 27A which is formed through the valve plate assembly 3 and the cylinder block 1 and opened to the valve chamber 71 thereby to communicate with the valve chamber 71. The valve chamber 71 also communicates with the suction chamber 21 through a communication hole 27B formed through the rear housing 4. The valve hole 27A, the valve chamber 71 and the communication hole 27B cooperatively form the release passage 27.

A spool 75 is movably received in the valve chamber 71 and the middle-diameter hole 72. A stop 76 is fixedly fitted in the large-diameter hole 73 at the step in the rear housing 4 between the large-diameter hole 73 and the middle-diameter hole 72 for preventing the spool 75 from moving beyond the rear end of the middle-diameter hole 72.

The spool 75 has a cylindrical small-diameter portion 75A located in the valve chamber 71 and a cylindrical large-diameter portion 75B formed coaxially with the small-diameter portion 75A and located in the middle-diameter hole 72. The spool 75 also has a movable annular-shaped step 78 formed between outer peripheral surfaces of the small-diameter portion 75A and the large-diameter portion 75B of the spool 75, serving as a valve body portion.

The small-diameter portion 75A of the spool 75 is coaxial with the valve hole 27A and has a diameter that is larger than that of the valve hole 27A. The front end of the small-diameter portion 75A facing the valve plate assembly 3 forms a first valve portion 79 that adjusts the degree of opening of the valve hole 27A to the valve chamber 71 (hereinafter referred to as the degree of opening of the valve hole 27A), that is, the cross-sectional area of the release passage 27. For example, when the first valve portion 79 is moved toward the valve plate assembly 3, the degree of opening of the valve hole 27A decreases and the cross-sectional area of the release passage 27 decreases, accordingly. On the other hand, when the first valve portion 79 is moved away from the valve plate assembly 3, the degree of opening of the valve hole 27A increases and the cross-sectional area of the release passage 27 increases, accordingly.

A back pressure chamber 80 is defined in the middle-diameter hole 72 between the stop 76 and the large-diameter portion 75B of the spool 75. The back pressure chamber 80 includes a cylindrical inner space formed in the large-diameter portion 75B. The spool 75 has a back surface 81 located in the back pressure chamber 80. A pressure introducing passage 82 branches off from the supply passage 29 at a position located nearer the pressure control chamber 5 in relation to the first control valve CV1 (downstream of the first control valve CV1 and also between the first control valve CV1 and the check valve 90), and communicates with the large-diameter portion 73 of the second control valve CV2. The stop 76 has formed therein a communication groove 76A and a communication hole 76B interconnecting the pressure introducing passage 82 and the middle-diameter hole 72.

The pressure in the supply passage 29 is applied to the back pressure chamber 80 through the pressure introducing passage 82, the communication groove 76A and the communication hole 76B. In other words, the pressure in the back pressure chamber 80 is substantially the same as that in the supply passage 29 downstream of the first control valve CV1 and urges the spool 75 toward the valve plate assembly 3 (i.e. in the direction to decrease the degree of opening of the valve hole 27A). When the pressure in the back pressure chamber 80 applied to the back surface 81 of the spool 75 increases, the first valve portion 79 decreases the degree of opening of the valve hole 27A thereby to decrease the cross-sectional area of the release passage 27.

A stationary annular step 83 as a valve seat is formed on an inner surface of the second control valve CV2 between the valve chamber 71 and the middle-diameter hole 72 of the second control valve CV2. When the spool 75 is moved closest to the valve plate assembly 3, the movable step 78 as a valve body portion is brought into contact with the stationary step 83.

The small-diameter portion 75A of the spool 75 is formed so that the axial length of the small diameter portion 75A is slightly smaller than that of the valve chamber 71. Thus, with the movable step 78 as the valve body portion seated on the stationary step 83 as the valve seat, a slight clearance is formed between the first valve portion 79 and the valve plate assembly 3 and a clearance 87 is also formed between the outer peripheral surface of the large-diameter portion 75B and the inner surface of the middle-diameter hole 72.

Therefore, when the degree of opening of the valve hole 27A is made minimum by the first valve portion 79, the release passage 27 is not closed completely and the pressure control chamber 5 always communicates with the suction chamber 21 through the release passage 27. Minimum degree of opening of the valve hole 27A means the degree of opening of the valve hole 27A that is slightly larger than zero and very close to zero, and the minimum cross-sectional area of the release passage 27 that is not zero. The minimum clearance between the first valve portion 79 and the valve plate assembly 3, that is not zero, functions as a throttle of the release passage 27. Thus, the second control valve CV2 adjusts a cross-sectional area of the release passage 27 from the minimum that is not zero, to the maximum.

A spring 85 is arranged over the outer peripheral surface of the small-diameter portion 75A of the spool 75 in contact at one end with the movable step 78 and at the other end with the valve plate assembly 3 for urging the spool 75 in the direction to increase the degree of opening of the valve hole 27A by moving the first valve portion 79 away from the valve plate assembly 3. The spring force of the spring 85 is set so extremely small that the spool 75 moves in the direction to decrease the degree of opening of the valve hole 27A in response to a small differential pressure between the pressure in the back pressure chamber 80 and the crank pressure Pc.

When the movable step 78 is positioned away from the stationary step 83, the valve chamber 71 communicates with the back pressure chamber 80. On the other hand, when the movable step 78 is seated on the stationary step 83, the communication between the valve chamber 71 and the back pressure chamber 80 by the refrigerant gas flowing between the valve body portion 78 and the valve seat is shut off. As previously mentioned, the movable step 78 serves as the valve body portion for shutting off the communication between the back pressure chamber 80 and the valve chamber 71.

The following will describe the check valve 90. The cylinder block 1 has formed therein at the end thereof adjacent to the pressure control chamber 5 a cylindrical accommodation hole 1B expanded radially from the supply passage 29. The check valve 90 is received in the accommodation hole 1B for preventing refrigerant gas from flowing from the pressure control chamber 5 to the first control valve CV1 through the supply passage 29. Opening of the accommodation hole 1B on the pressure control chamber 5 side of the cylinder block 1 is partly closed by an annular-shaped cap 91. The check valve 90 includes a valve body 92 provided in the accommodation hole 1B and a check valve spring 93 for urging the valve body 92 rearward.

The rear side of the valve body 92 is cone-shaped and a valve part 92A is formed on the conical surface of the valve body 92. When the valve part 92A is seated on the peripheral edge of the opening of the supply passage 29, as shown in FIG. 4, the supply passage 29 is closed. The check valve spring 93 urges the valve body 92 in the direction to close the supply passage 29. The pressure in the pressure control chamber 5 (crank pressure Pc) is applied to the accommodation hole 1B through a hole 91A formed through the annular cap 91.

When the valve body 92 of the check valve 90 closes the supply passage 29, the pressure present downstream of the first control valve CV1 acts on the valve part 92A of the valve body 92. Then, the pressure receiving area of the valve part 92A is substantially the same as the cross-sectional area, S1 of the supply passage 29. With the supply passage 29 thus closed by the valve body 92, the pressure in the pressure control chamber 5 (crank pressure Pc) acts on the pressure receiving surface 92B of the valve body 92 of the check valve 90 and the pressure receiving area of the surface 92B is substantially the same as the pressure receiving surface 92B, S2 (>S1).

The check valve operates with dead band so that opening pressure where the check valve operates from close to open is higher than closing pressure where the check valve operates from open to close, wherein the differential pressure of the second control valve is set between the opening pressure and the closing pressure of the check valve. If the spring force of the check valve spring 93 is FB, opening pressure Pdc1 necessary for the valve body 92 to open the supply passage 29 in the check valve 90 is expressed as FB/S1. On the other hand, when the valve body 92 closes the supply passage 29, closing pressure Pdc2 necessary for the valve body 92 to close the supply passage 29 is expressed as FB/S2. The differential pressure between the pressure in the back pressure chamber 80 and the crank pressure Pc in the valve chamber 71 at which the degree of opening of the valve hole 27A is minimized by the spool 75 of the control valve CV2 will be referred to as the closing differential pressure Pcs of the second control valve CV2. In other words, when the difference between the pressure in the back pressure chamber 80 and the sum of the pressure in the valve chamber 71 and the urging force of the spring 85 is more than Pcs, the spool 75 of the second control valve CV2 moves in the direction to decrease the degree of opening of the valve hole 27A. In the second control valve CV2, since the difference of the front and rear pressure receiving areas of the second control valve CV2 between when the movable step 78 and the stationary step 83 are spaced away from each other and when the movable step 78 is seated on the stationary step 83 is very small, the closing differential pressure of the second control valve CV2 will be regarded as approximate to Pcs in this embodiment.

In the present embodiment, the cross-sectional area perpendicular to the axis of the supply passage 29, the cross-sectional area perpendicular to the axis of the accommodation hole 1B, the spring force of the check valve spring 93, FB and the valve closing conditions of the second control valve CV2 and the check valve 90 are set to satisfy the following conditional expression 1.

$$Pdc2<Pcs<Pdc1: \qquad \text{conditional expression 1}$$

The pressure that is present in the pressure control chamber 5 before the inclination angle of the swash plate 12 is changed (the swash plate 12 being positioned only by the spring 15) after a start-up of the compressor, and also is smaller than the pressure at which the swash plate 12 changes its inclination angle when the degree of opening of the first control valve CV1 is maximum, will be referred to as variable pressure Pk. The compressor C of this embodiment is set to satisfy the following conditional expression 2.

$$Pcs<Pk=(Pc-Ps): \qquad \text{conditional expression 2}$$

When a predetermined time or more has passed after a stop of the vehicle engine E, the pressure in the refrigerant circuit is equalized under a low pressure and finally the crank pressure Pc and the suction pressure Ps become the same. In the second control valve CV2, the spool 75 is moved by the spring force of the spring 85 in the direction to increase the degree of opening of the valve hole 27A into contact with the stop 76 and the degree of opening of the valve hole 27A is made maximum, as shown in FIG. 4. When the current supply to the solenoid 40 of the first control valve CV1 is stopped (the duty ratio then being zero) with the air conditioner switch turned off, the degree of opening of the first control valve CV1 is maximum. In other words, the cross-sectional area of the supply passage 29 is maximum. In the check valve 90, the supply passage 29 is closed by the valve part 92A urged by the spring force of the check valve spring 93.

In the compressor C for a general air conditioner, when the engine E is left in a stopped state for a long time and there exists liquefied refrigerant on low pressure side of the external refrigerant circuit 30 of the compressor C, the liquefied refrigerant flows into the pressure control chamber 5 through the suction chamber 21 because the pressure control chamber 5 communicates with the suction chamber 21 through the release passage 27. Especially when the temperature in the vehicle compartment is high and the temperature in the engine room where the compressor is disposed is low, a lot of the liquefied refrigerant flows into the pressure control chamber 5 through the suction chamber 21 to be accumulated in the pressure control chamber 5.

When the engine E is started and the compressor C starts to operate (as explained before, the power transmission mechanism PT is of continuous transmission type, that is clutchless mechanism), the liquefied refrigerant is vaporized under the influence of heat from the engine E and stirring by the swash plate, with the result that the crank pressure Pc increases regardless of the degree of opening of the first control valve CV1. The minimum inclination angle of the swash plate 12 is slightly larger than 0° and refrigerant gas is discharged from the cylinder bore 1A to the discharge chamber 22 at this minimum inclination angle of the swash plate 12. Since the pressure in the valve chamber 71 is then higher than that in the back pressure chamber 80, the second control valve CV2 is kept in a state in which the cross-sectional area of the release passage 27 is maximum.

When the crank pressure Pc becomes larger than the pressure in the discharge chamber 22, the crank pressure Pc is prevented from acting on the supply passage 29 because of the presence of the check valve 90. Accordingly, the crank pressure Pc is prevented from acting on the back pressure chamber 80 through the supply passage 29, the pressure introducing passage 82, the communication groove 76A and the communication hole 76B. Therefore, the high-pressure crank pressure Pc does not act on the back surface 81 of the spool 75.

Consequently, the first valve portion 79 of the spool 75 of the second control valve CV2 keeps the degree of opening of the valve hole 27A of the release passage 27 maximum due to the urging force of the spring 85 (the first valve portion 79 of the spool 75 of the second control valve CV2 is kept by the urging force of the spring 85 at the position to make the valve hole 27A wide-open based on the differential pressure between the crank pressure Pc and the pressure in the supply passage 29). Therefore, the liquefied refrigerant in the pressure control chamber 5 is discharged as it is or in at least partially vaporized state to the suction chamber 21 rapidly through the release passage 27 then having the maximum cross-sectional area.

When the differential pressure between the back pressure chamber 80 and the valve chamber 71 becomes larger than the closing differential pressure Pcs of the second control valve CV2 due to the discharge of liquefied refrigerant from the pressure control chamber 5 and the subsequent decrease of the crank pressure Pc, the spool 75 of the second control valve CV2 is urged by the pressure in the back pressure chamber 80 in the direction to minimize the degree of opening of the valve hole 27A and the cross-sectional area of the release passage 27 decreases from the maximum, as shown in FIG. 3. When the differential pressure between the pressure in the supply passage 29 and the crank pressure Pc becomes larger than the opening pressure Pdc1 of the check valve 90, the refrigerant gas in the supply passage 29 flows into the pressure control chamber 5 while pushing open the valve body 92 of the check valve 90, and the valve body 92 of the check valve 90 is opened.

For example, when the temperature in the vehicle compartment is high after a start-up of the engine E, the controller 47 sets the duty ratio maximum in response to the cooling demand from a driver. The first control valve CV1 sets the degree of opening of the first control valve CV1 minimum and the cross-sectional area of the supply passage 29 becomes minimum, accordingly. Since no high-pressure refrigerant gas is supplied from the discharge chamber 22 to the pressure control chamber 5 and the back pressure chamber 80 of the second control valve CV2, the pressure in the back pressure chamber 80 decreases.

When the differential pressure between the back pressure chamber 80 and the valve chamber 71 becomes less than the closing differential pressure Pcs of the second control valve CV2, the spool 75 is moved in the direction to maximize the degree of opening of the valve hole 27A thereby to maximize the cross-sectional area of the release passage 27. When the differential pressure between the pressure in the supply passage 29 and the crank pressure Pc becomes less than the opening pressure Pdc1 of the check valve 90, the valve body 92 of the check valve 90 is moved in the direction to close the supply passage 29. In this case, the valve body 92 of the check valve 90 is moved in the direction to close the supply passage 29 after the spool 75 moves in the direction to maximize the degree of opening of the valve hole 27A, based on the conditional expression 1, as shown in FIG. 4. Then the crank pressure Pc is kept under a low pressure in accordance with the degree of opening of the first control valve CV1. Accordingly, the compressor C increases the inclination angle of the swash plate 12 rapidly thereby to operate at the maximum displacement.

When the vehicle compartment is cooled down to the desired level due to the maximum displacement operation of the compressor C, the controller 47 changes the current supply to the solenoid 40 of the first control valve CV1 between the minimum and the maximum (duty ratio being more than 0 but less than 1) thereby to set the degree of opening of the first control valve CV1 more than minimum. In other words, the cross-sectional area of the supply passage 29 is set larger than minimum. Accordingly, high-pressure refrigerant gas is supplied from the discharge chamber 22 to the pressure control chamber 5 and the back pressure chamber 80 of the second control valve CV2 and the pressure in the back pressure chamber 80 increases.

When the differential pressure between the back pressure chamber 80 and the valve chamber 71 becomes larger than the closing differential pressure Pcs of the second control valve CV2, the spool 75 moves in the direction to minimize the degree of opening of the valve hole 27A and the cross-sectional area of the release passage 27 is minimized, accordingly. If the differential pressure between the pressure in the supply passage 29 and the crank pressure Pc becomes larger than the opening pressure Pdc1 of the check valve 90, the valve body 92 of the check valve 90 moves in the direction to open the supply passage 29. In this case, the valve body 92 of the check valve 90 moves in the direction to open the supply passage 29 after the spool 75 moves in the direction to minimize the degree of opening of the valve hole 27A, as shown in FIG. 3, based on the conditional expression 1.

Refrigerant gas is discharged to the suction chamber 21 through the release passage 27 and the refrigerant gas in the supply passage 29 flows into the pressure control chamber 5 through the check valve 90. In this state, the inclination angle of the swash plate 12 is controlled so that the suction pressure Ps becomes a set pressure in accordance with the duty ratio, with the result that the compressor C operates at an intermediate displacement with the swash plate 12 placed at an inclination angle larger than the minimum.

The following advantageous effects are obtained according to the above-described first preferred embodiment.

(1) The second control valve CV2 is provided in the release passage 27 for adjusting the cross-sectional area of the release passage 27 and the check valve 90 is provided in the supply passage 29 between the pressure control chamber 5 and the first control valve CV1. If the crank pressure Pc is increased by stirring of liquefied refrigerant or high-pressure blow-by gas is discharged to the pressure control chamber 5, the check valve 90 prevents the crank pressure Pc from acting on the back pressure chamber 80 of the second control valve CV2. Therefore, if the crank pressure Pc becomes larger than the pressure acting on the back pressure chamber 80 of the second control valve CV2, the spool 75 is prevented from moving in the direction to minimize the degree of opening of the valve hole 27A, so that the second control valve CV2 can open and close the valve hole 27A at proper timing. Consequently, the problem due to the improper timing of opening and closing the valve hole 27A of the second control valve CV2 can be solved and the deterioration of the operating efficiency of the compressor C can be prevented.

(2) If the check valve 90 opens the supply passage 29 before the second control valve CV2 makes the degree of opening of the valve hole 27A minimum when the first control valve CV1 makes the degree of opening larger than minimum, the crank pressure Pc cannot be increased rapidly because the refrigerant gas supplied from the first control valve CV1 to the pressure control chamber 5 through the supply passage 29 is discharged to the suction chamber 21 through the release passage 27. When the first control valve CV1 makes the degree of opening larger than minimum, the check valve 90 is set to open the supply passage 29 after the second control valve CV2 makes the degree of opening of the valve hole 27A minimum. Thus, when the first control valve CV1 makes the degree of opening larger than minimum, the crank pressure Pc can be increased rapidly and the operating efficiency of the compressor C can be improved.

(3) If the check valve 90 closes the supply passage 29 before the second control valve CV2 makes the degree of opening of the valve hole 27A maximum when the first control valve CV1 makes the degree of opening minimum, the second control valve CV2 can not make the degree of opening of the valve hole 27A larger than minimum because the pressure in the back pressure chamber 80 does not decrease. When the discharge pressure Pd is high or the blow-by gas is discharged to the pressure control chamber 5 excessively, the inclination angle of the swash plate 12 can not be adjusted to a desired angle because the crank pressure Pc increases excessively. Therefore, when the first control valve CV1 makes the degree of opening minimum, the check valve 90 is set to close the supply passage 29 after the second control valve CV2 makes the degree of opening of the valve hole 27A maximum. Thus, when the first control valve CV1 makes the degree of opening minimum, the aforementioned trouble can be prevented because the second control valve CV2 opens the valve hole 27A thereby to open the release passage 27 for sure.

(4) If the inclination angle of the swash plate 12 changes before the second control valve CV2 makes the degree of opening of the valve hole 27A minimum, the crank pressure Pc can not be increased rapidly because part of the refrigerant gas supplied to the pressure control chamber 5 is discharged to the suction chamber 21 through the release passage 27 and also the amount of refrigerant gas to be supplied to the first control valve CV1 becomes insufficient. According to the above-described embodiment, it is so arranged that if the compressor displacement is decreased while the swash plate 12 is balanced at an inclination angle, the check valve 90 opens the supply passage 29 so that the swash plate 12 inclines toward the minimum angle position after the spool 75 of the second control valve CV2 moves in the direction to make the degree of opening of the valve hole 27A minimum. Thus, when the inclination angle of the swash plate 12 changes, the crank pressure Pc can be increased rapidly and, therefore, the operating efficiency of the compressor C can be improved.

(5) If the check valve 90 closes the supply passage 29 before the second control valve CV2 makes the degree of opening of the valve hole 27A minimum when the crank pressure Pc is decreased with the degree of opening of the first control valve CV1 set to minimum, the pressure in the back pressure chamber 80 does not decrease after the check valve 90 closes the supply passage 29. In order to solve such problem, the closing differential pressure Pcs of the second control valve CV2 is set larger than the opening pressure Pdc1 of the check valve 90 so that the crank pressure Pc can be decreased rapidly.

(6) The spool 75 of the second control valve CV2 is urged by the spring 85 in the direction to increase the degree of opening of the valve hole 27A and the valve body 92 of the check valve 90 is urged by the spring 93 in the direction to close the supply passage 29. Therefore, the spool 75 of the second control valve CV2 can be moved rapidly and surely in the direction to increase the degree of opening of the valve hole 27A by the spring 85 and also the valve body 92 of the check valve 90 can be moved rapidly and surely in the direction to close the supply passage 29 by the spring 93.

Second Embodiment

The following will describe the second embodiment of a variable displacement type compressor (hereinafter, simply referred to as compressor) with a displacement control mechanism according to the present invention, which may be used for a vehicle air conditioner to compress refrigerant gas.

Figure 5:
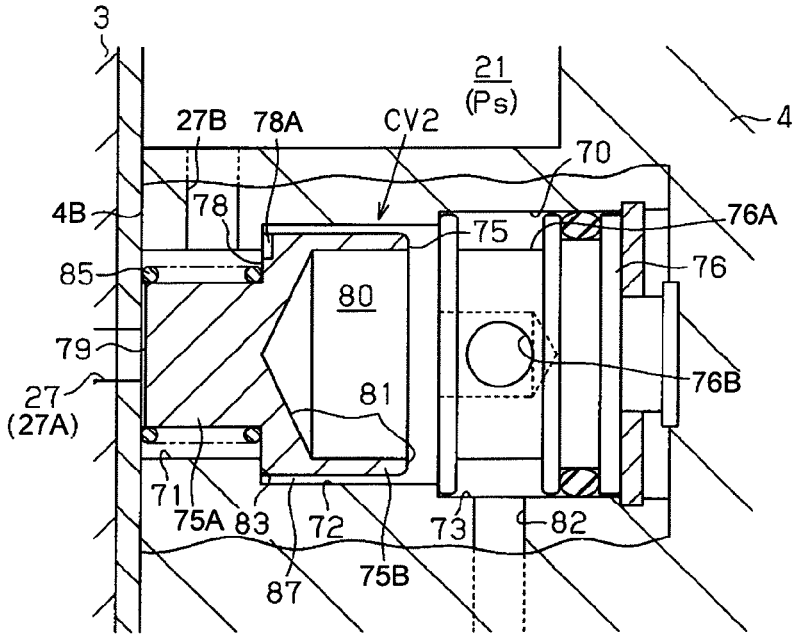
FIG. 5 is an enlarged fragmentary cross-sectional view of a second control valve of a variable displacement type compressor according to a preferred second embodiment of the present invention.

Referring to FIG. 5 showing the second embodiment of compressor in an enlarged fragmentary cross-sectional view, a groove 78A is formed in the step 78 of the spool 75 of the second control valve CV2 at a position adjacent to the outer periphery of the large-diameter portion 75B of the spool 75. The groove 78A interconnects the valve chamber 71 and the back pressure chamber 80 through the clearance 87 between the outer peripheral surface of the large-diameter portion 75B and the inner surface of the middle-diameter hole 72 when the movable step 78 is seated on the stationary step 83 to minimize the degree of opening of the valve hole 27A by the spool 75. Thus, the groove 78A and the clearance 87 cooperate to form a passage interconnecting the valve chamber 71 and the back pressure chamber 80.

When the degree of opening of the first control valve CV1 is changed to minimum from a state where the opening of the first control valve CV1 is larger than minimum and also the opening of the valve hole 27A is made minimum by the second control valve CV2, so as to make the compressor to operate at its maximum displacement, there is a fear that an excessive amount of refrigerant gas may be discharged to the back pressure chamber 80 if refrigerant gas is leaked through the first control valve CV1 due to the presence of any foreign matters or to any other reason. Because the movable step 78 is then seated on the stationary step 83, the spool 75 can not be moved in the direction to increase the degree of opening of the valve hole 27A if the refrigerant gas leaked through the first control valve CV1 is flowed to the back pressure chamber 80.

However, in the second embodiment wherein the groove 78A is formed in the movable step 78, the back pressure chamber 80 communicates with the valve chamber 71 through the clearance 87 and the groove 78A. Therefore, refrigerant gas flowed to the back pressure chamber 80 excessively can be discharged to the suction chamber 21 through the groove 78A, the valve chamber 71 and the communication hole 27B.

According to the second preferred embodiment of the present invention, if refrigerant gas leaked through the first control valve CV1 is flowed to back pressure chamber 80 excessively when the degree of opening of the first control valve CV1 is minimum, the spool 75 of the second control valve CV2 can be moved in the direction to increase the degree of opening of the valve hole 27A, with the result that the compressor can change from the intermediate displacement operation to the maximum displacement operation rapidly.

Third Embodiment

The following will describe the third embodiment of a variable displacement type compressor (hereinafter, simply referred to as compressor) with a displacement control mechanism according to the present invention, which may be used for a vehicle air conditioner to compress refrigerant gas.

Figure 6:
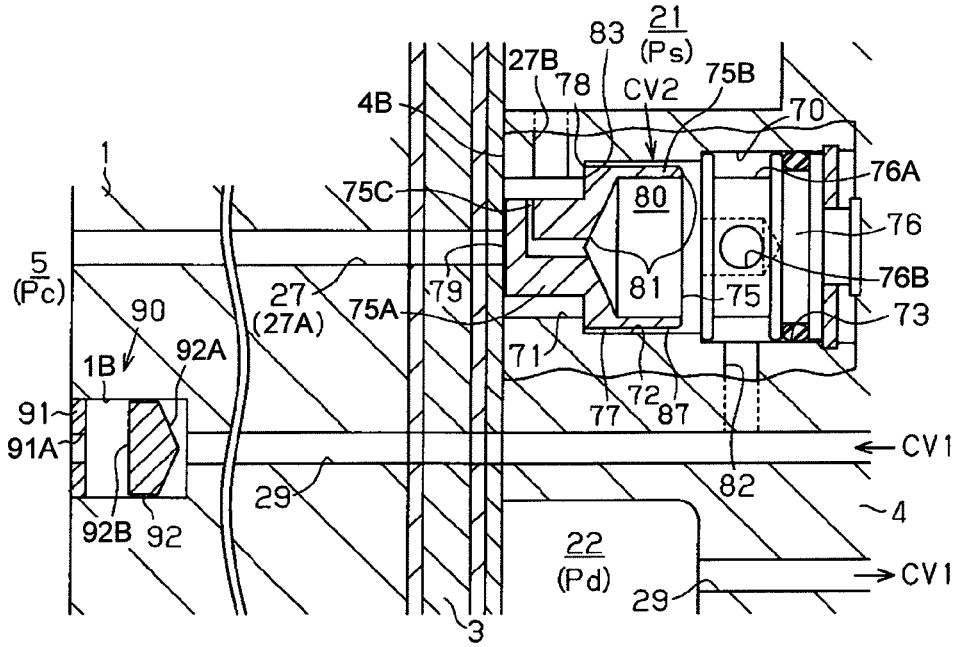
FIG. 6 is an enlarged fragmentary cross-sectional view of a second control valve and a check valve of a variable displacement type compressor according to a preferred third embodiment of the present invention.

Referring to FIG. 6 showing the third embodiment of compressor in an enlarged fragmentary cross-sectional view, the spool 75 of the second control valve CV2 has formed therethrough a passage 75C interconnecting the back pressure chamber 80 and the valve chamber 71. One end of the passage 75C is opened at the back surface 81 of the spool 75 to the back pressure chamber 80 and the other end of the passage 75C is opened at the outer peripheral surface of the small-diameter portion 75A to the valve chamber 71. Thus, refrigerant gas in the back pressure chamber 80 can be supplied to the valve chamber 71 through the passage 75C.

The compressor of the third embodiment dispenses with the spring 85 of the second control valve CV2 and the check valve spring 93 of the check valve 90. The spool 75 of the second control valve CV2 is guided to move along the inner surface of the middle-diameter hole 72 and the valve body 92 of the check valve 90 is guided to move along the inner surface of the accommodation hole 1B, respectively.

In such structure of the compressor, when the degree of opening of the first control valve CV1 is minimum and the degree of opening of the valve hole 27A of the second control valve CV2 is also minimum, the pressure in the back pressure chamber 80 becomes the same as the pressure in the valve chamber 71 (suction pressure Ps) due to the presence of the passage 75C. The force for moving the spool 75 of the second control valve CV2 is set by the pressures of the back pressure chamber 80 and the valve chamber 71 and the areas (pressure receiving areas) of the back surface 81 and the first valve portion 79. When the degree of opening of the first control valve CV1 is minimum, the spool of the second control valve CV2 moves in the direction to increase the degree of opening of the valve hole 27A.

When the degree of opening of the first control valve CV1 is increased from the minimum, the differential pressure between the pressure acting on the back pressure chamber 80 and the pressure acting on the valve chamber 71 from the pressure control chamber 5 is generated. The crank pressure Pc acting on the first valve portion 79 of the second control valve CV2 is influenced by the pressure losses due to the cross-sectional areas of the supply passage 29 in which the check valve 90 is provided and the release passage 27 and also due to the check valve 90. On the other hand, the pressure acting on the back surface 81 of the second control valve CV2 is influenced by the pressure losses due to the cross-sectional areas of the supply passage 29 and the pressure introducing passage 82. Then, the pressure loss due to the former is larger than that due to the latter.

If the receiving area of the back surface 81 is set larger than the cross-sectional area of the valve hole 27A, the spool 75 of the second control valve CV2 can be moved in the direction to make the degree of opening of the valve hole 27A minimum when the degree of opening of the first control valve CV1 increases from the minimum, by virtue of the application of pressure through the supply passage 29.

Thus, providing the passage 75C in the spool 75, adjusting the cross-sectional areas of the release passage 27, the supply passage 29 and the pressure introducing passage 82 and adjusting also the size of the spool 75 permit the second control valve CV2 to operate at the desired timing without using the spring 85 for the second control valve CV2 and the spring 93 for the check valve 90.

Fourth Embodiment

The following will describe the fourth embodiment of a variable displacement type compressor (hereinafter, simply referred to as compressor) with a displacement control mechanism according to the present invention, which may be used for a vehicle air conditioner to compress refrigerant gas. In the fourth embodiment, both of the opening and closing pressures Pdc1 and Pdc2 are set smaller than the closing differential pressure Pcs of the second control valve CV2. The aforementioned variable pressure Pk is expressed by the following conditional expression.

$$Pk=(Pc-Ps)=k(Pd-Ps): \qquad \text{conditional expression 3}$$

wherein k is a factor decided in setting the compressor C. In the fourth embodiment, the opening and closing pressures Pdc1 and Pdc2 of the check valve 90 are set 0.004 Mpa, the closing differential pressure Pcs of the second control valve CV2 is set 0.005 Mpa and the variable force Pk is set 0.007 Mpa. As long as Pcs<Pk=(Pc−Ps) (conditional expression 2) is satisfied, when decreasing the compressor displacement at a start-up of the compressor C with the swash plate 12 then placed in a balanced inclination angle position, the amount of the refrigerant gas to be flowed into the first control valve CV1 is secured and the pressure in the pressure control chamber 5 is increased rapidly. The operating characteristic of the check valve 90 can be set easily and the flexibility of design is improved, accordingly.

Figure 7:
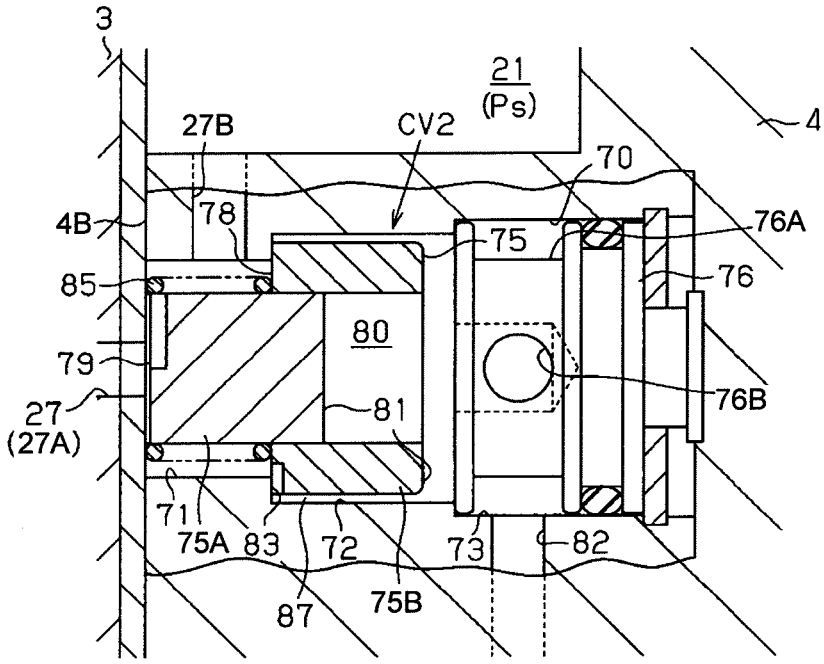
FIG. 7 is an enlarged fragmentary cross-sectional view of a second control valve of a variable displacement type compressor according to an alternative embodiment of the present invention.

The above embodiments may be modified as follows. As shown in FIG. 7, the small-diameter portion 75A and the large-diameter portion 75B of the spool 75 may be provided by separate parts which are assembled together by press-fitting. In such alternative embodiment, the end face of the part corresponding to the small-diameter portion 75A of the preceding embodiments on the side adjacent to the valve hole 27A is formed with a cutout covering half of the valve hole 27A. Thus, the cross-sectional area of the release passage 27 may be changed by adjusting the degree of opening of the valve hole 27A with the cutout. Furthermore, in assembling of the compressor C, the stationary step 83 of the accommodation hole 70 and the valve plate assembly 3 may be utilized as the stop when the parts corresponding to the small-diameter portion 75A and the large-diameter portion 75B of the spool 75 in the accommodation hole 70 are press-fitted. By so doing, dimensional adjustment of the spool 75 may be facilitated.

Alternatively, the check valve 90 may be provided in the rear housing 4. The present invention may be applied to a variable displacement type compressor in which the rotary shaft 6 is connected to the engine E through a clutch for transmitting drive force from the engine E to the compressor. The first control valve CV1 may be realized by a solenoid valve controlled with duty ratio or a proportional solenoid valve.

What is claimed is:

1. A variable displacement type compressor in which a discharge-pressure region, a suction-pressure region and a pressure control chamber are defined, having an inclinable swash plate disposed in the pressure control chamber and a piston reciprocated by the swash plate, wherein the inclination angle of the swash plate and the piston stroke are changed by adjustment of pressure in the pressure control chamber thereby to control the displacement of the compressor, the compressor comprising:

a supply passage for supplying refrigerant gas from the discharge-pressure region to the pressure control chamber;

a release passage for releasing the refrigerant gas from the pressure control chamber to the suction-pressure region;

a first control valve for controlling the amount of the refrigerant gas flowing through the supply passage;

a check valve provided in the supply passage between the first control valve and the pressure control chamber and preventing the refrigerant gas from flowing from the pressure control chamber to the first control valve by closing the supply passage, wherein the check valve opens and closes the supply passage in accordance with the differential pressure between the pressure in the supply passage and the pressure in the pressure control chamber; and a second control valve for adjusting a cross-sectional area of the release passage from minimum to maximum, the second control valve including:

a back pressure chamber communicating with the supply passage at a position located between the first control valve and the check valve, wherein the check valve further prevents the refrigerant gas from flowing from the pressure control chamber to the back pressure chamber by closing the supply passage;

a valve chamber forming a part of the release passage and communicating with the suction-pressure region;

a valve hole forming a part of the release passage and communicating with the valve chamber;

a spool having a valve portion located in the valve chamber and a back surface located in the back pressure chamber, wherein when a pressure in the back pressure chamber increases, the valve portion decreases the degree of opening of the valve hole;

a valve body portion provided in the spool;

a valve seat provided on an inner surface of the second control valve between the valve chamber and the back pressure chamber; and a passage which interconnects the back pressure chamber and the valve chamber so that the refrigerant gas in the back pressure chamber flows to the valve chamber even when the valve portion of the second control valve makes the degree of opening of the valve hole of the second control valve minimum, wherein when the valve body portion is seated on the valve seat, the valve portion of the second control valve makes the degree of opening of the valve hole of the second control valve minimum.

2. The variable displacement type compressor according to claim 1, wherein when the second control valve adjusts the cross-sectional area of the release passage the minimum, the minimum is not zero.

3. The variable displacement type compressor according to claim 1, wherein when the valve portion of the second control valve makes the degree of opening of the valve hole minimum, the second control valve functions as a throttle of the release passage.

4. The variable displacement type compressor according to claim 1, wherein the second control valve further includes:

a spring for urging the spool of the second control valve in the direction to increase the degree of opening of the valve hole, wherein the check valve further includes:

a spring for urging a valve body of the check valve in the direction to close the supply passage.

5. The variable displacement type compressor according to claim 1, wherein when the first control valve makes the degree of opening thereof larger than minimum, the check valve is set to open the supply passage after the second control valve makes the degree of opening of the valve hole thereof minimum.

6. The variable displacement type compressor according to claim 1, wherein when the first control valve makes the degree of opening thereof minimum, the check valve is set to close the supply passage after the second control valve makes the degree of opening of the valve hole thereof maximum.

7. The variable displacement type compressor according to claim 1, wherein closing differential pressure for minimizing the degree of opening of the valve hole of the second control valve is set larger than closing pressure of the check valve and is also set smaller than a pressure in the pressure control chamber at which the swash plate changes its inclination angle when the degree of opening of the valve hole of the first control valve is maximum at a start-up of the compressor.

8. The variable displacement type compressor according to claim 7, wherein the check valve operates with dead band so that opening pressure where the check valve operates from close to open is higher than closing pressure where the check valve operates from open to close, wherein the differential pressure of the second control valve is set between the opening pressure and the closing pressure of the check valve.

9. The variable displacement type compressor according to claim 1, wherein when the valve body portion is positioned away from the valve seat, the back pressure chamber communicates with the valve chamber and when the valve body portion is seated on the valve seat, the communication between the back pressure chamber and the valve chamber by the refrigerant gas flowing between the valve body portion and the valve seat is shut off.

10. The variable displacement type compressor according to claim 9, the second control valve further comprising:

a passage provided in the spool, wherein the passage interconnects the back pressure chamber and the valve chamber so that the refrigerant gas in the back pressure chamber flows to the valve chamber.

* * * * *